United States Patent [19]

Ballmann

[11] 4,296,893

[45] Oct. 27, 1981

[54] PROJECTILE WITH SPIN-PRODUCING FLOW PASSAGES

[76] Inventor: Josef Ballmann, Oberforstbacher Str. 228, D-5100 Aachen, Fed. Rep. of Germany

[21] Appl. No.: 21,606

[22] PCT Filed: Jul. 3, 1978

[86] PCT No.: PCT/DE78/00008

§ 371 Date: Mar. 9, 1979

§ 102(e) Date: Mar. 8, 1979

[87] PCT Pub. No.: WO79/00037

PCT Pub. Date: Feb. 8, 1979

[51] Int. Cl.[3] ..... F42B 13/24; F42B 15/14

[52] U.S. Cl. ..... 244/3.23; 102/501; 102/520

[58] Field of Search ..... 244/3.23, 3.1; 102/93, 102/DIG. 1, 92.1, 38 R

[56] References Cited

U.S. PATENT DOCUMENTS

| | | | |
|---|---|---|---|
| 2,559,955 | 7/1951 | Hartwell | 244/3.23 |
| 3,058,423 | 10/1962 | Laager | 244/3.23 |
| 3,394,905 | 7/1968 | Rapp | 244/3.23 |
| 3,398,682 | 8/1968 | Abela | 244/3.23 |
| 3,419,230 | 12/1968 | Mainhardt et al. | 244/3.23 |
| 3,724,781 | 4/1973 | Makow | 244/3.23 |
| 3,970,004 | 7/1976 | Suter | 244/3.23 |
| 4,063,511 | 12/1977 | Bullard | 244/3.23 |

FOREIGN PATENT DOCUMENTS

| | | | |
|---|---|---|---|
| 2237169 | 2/1975 | France | 244/3.23 |
| 328454 | 8/1935 | Italy | 244/3.23 |

*Primary Examiner*—Harold J. Tudor

*Attorney, Agent, or Firm*—Finnegan, Henderson, Farabow, Garrett & Dunner

[57] ABSTRACT

A projectile for shooting from a gun barrel in response to the force of a propellant gas emanating from the aperture of a propellant container, comprising a projectile body having a plurality of spin-producing propellant gas flow passages associated therewith, said passages annularly surrounding, and having their respective axes extending obliquely to, the longitudinal axis of the projectile body, wherein each passage has an inlet portion converging to an adjoining constricted portion, and a diverging portion extending downstream from the constricted portion, the axis of each passage being curved over the entire length of its converging inlet portion and substantially rectilinear over its diverging portion, and the walls of the diverging portion of each passage having a substantially rectilinear form, as viewed in the direction of propellant gas flow.

12 Claims, 11 Drawing Figures

PROJECTILE WITH SPIN-PRODUCING FLOW PASSAGES

DESCRIPTION

The invention relates to a projectile, particularly for shooting from a smooth barrel, comprising guide members and/or a propulsion member or without such accessories, equipped with spin-producing flow passages which, on the inlet side, have a converging portion with an adjoining constriction and, adjoining downstream thereof, a diverging portion in which the propellant gas reaches supersonic speed.

The projectile of the invention can be one having a solid projectile body or a tubular projectile body. Further, it may be with or without steering gear.

In so far as the projectile according to the invention comprises guide members, these can be of the known kind consisting of a cage or of rings by which the body of the projectile is surrounded with a positive fit. The cage as well as the rings will in that case preferably comprise a plurality of releasably interconnected segments or segments that are merely interconnected by frangible portions. The propulsion member of the projectile, if such is provided, is as usual disposed between the front end of the propellant container and the rear of the projectile body without being permanently connected to the latter. It may be of one or more parts. Further, it is possible to combine it with the guide members to form a unit.

Projectiles of the kind in question are not only provided for sharp-shooting but they are also used to a large extent as so-called training projectiles for target practice.

It is desirable to provide such projectiles with spin, the extent of spinning being adapted to the departure and flight properties of a particular type of projectile, and to obtain spinning even when shot from a smooth barrel.

In the case of aerodynamically unstable projectiles, spinning serves particularly for obtaining flight stability of the projectile. The rotary speed about the longitudinal axis of the projectile, also termed trajectory flatness, is given by the shape and mass geometry of the projectile body.

It is known that projectiles of the stated kind can have spin imparted to them in the barrel by providing the latter with so-called rifling. The projectiles in this case are slightly over-dimensioned over at least part of their peripheral surface so that, upon firing, they are first pressed into the rifling and then follow the rifling almost with a positive fit. With this method of producing spin, the extent of spinning on departure is given by the angle of the rifling in the barrel and the muzzle velocity of the projectiles. This fact makes any kind of spin control impossible if one wants to fire different projectile shapes from the same barrel or obtain different muzzle velocities, as is desired particularly for target practice but may also be desirable for sharp-shooting. The result is defective flight and target behaviour of the projectile body.

However, projectile shapes have also become known in which the projectiles are made in one piece and provided with so-called spin passages along their outer periphery or in the interior. These spin passages are traversed by the propellant gases on firing and permit spinning projectiles to be shot from smooth barrels. By appropriately shaping the passages, they also permit selection of the trajectory flatness independently of the muzzle velocity of the projectiles for the same barrel. However, the known projectile constructions in question have not proved successful because of their external ballistic problems and because of an unfavourable shape for their spin passages.

Physically, the spin of the projectile is produced in that the part of the propellant gases that overtakes the projectile in its travel through the spin passages is given a circumferential speed component by the projectile, which leads to oppositely directed trajectory flatness of the projectile.

The spin passages of known projectiles are on the one hand spiral passages extending helically about the projectile axis and with a constant or converging cross-section in which the propellant gas can, at most, flow at sonic speed. On the other hand, a projectile with spin passages has become known, which passages, following a converging portion and a constriction, diverge again so that the pressure conditions obtaining in the barrel the gas in the diverging portion reaches supersonic speed. However, see, for example, German Pat. DT-PS No. 597 633. In this case the gas receives its circumferential speed, after it has reached supersonic speed, only at a so-called impact face disposed at the rear end of the passages at one side thereof and set obliquely for impingement purposes. This type of flow deflection makes more use of the energy content of the propellant gases for the purpose of producing spinning but a good part of it is lost again for spin production because of the deflection of the supersonic flow at the impact face accompanied by shock waves.

In all known projectiles, the result is a large requirement of propellant gas for producing spin and, with a view to achieving the highest possible muzzle velocity for the projectiles, this must be regarded as a loss that is not compensated by the absence of frictional forces which occur in addition to the normal wall friction when producing spin in rifling. The highest possible efficiency of spin production is sacrificed right from the start by sacrificing either the supersonic speed or impact-free deflection.

The invention is based on the problem of constructing a projectile of the aforementioned kind with spin-producing flow passages which permit the projectile to be shot with a spin of which the trajectory flatness is selectable independently of the muzzle velocity and brings about stabilization of the projectile body as well as flight thereof adapted to the ballistic requirements, whereby such spin is achieved with the lowest possible losses.

This problem is solved according to the invention in that in such a projectile the respective axis of the spin passages in the diverging portion thereof extends rectilinearly or slightly curved obliquely at a spacing from the projectile axis and that to avoid shock waves the walls of the diverging passage portion have, as viewed in the direction of flow, a convex and/or straight form and/or at most a slightly concavely curved form.

The spin-producing flow passages or spin passages are traversed by the propellant gas when the projectile according to the invention is fired and then bring about the desired spin.

When producing spin in accordance with the invention, the propellant gas flowing through the spin passages has a change in spin about the barrel axis imposed on it by the boundaries of the spin passages, i.e. a change in its flow velocity in the peripheral direction of the barrel. The arrangement and construction of the spin passages in accordance with the invention here facilitates a particularly high degree of utilization of the energy of the propellant gases for the purpose of producing spin.

The configuration of the axis and the shape of the walls of the spin passages as provided by the invention are governed by the requirement that no shock waves or only very weak shock waves causing negligible losses are created and the propellant gas leaves the spin passages at the highest possible supersonic speed and with the largest possible spin in reference to the projectile axis.

Accordingly, in the new projectile the axis of the spin passages at the outlet of the passage is disposed at the largest possible spacing from the barrel axis and directed so that the highest possible circumferential component of the gas velocity is produced. Further, the walls of the spin passages for this purpose have the aforementioned shape in the diverging portion thereof because this completely or almost completely avoids shock waves.

In the new projectile, the invention can also provide for each spin passage to have an axis which is continuously or discontinuously curved in the converging portion. One then possibly obtains additional spin through the deflection and the associated change in direction of the propellant gases in the converging portion of the spin passages.

Further, provision can be made in the new projectile according to the invention for an extension to be provided at the outlet end of the spin passages on the pressure side of their wall. This extension then intensifies the velocity component of the propellant gas in the circumferential direction of the barrel and thus further facilitates the production of spin.

In the described embodiments of the projectile according to the invention, each spin passage may have an axis extending at a constant or only slightly varying spacing from the projectile axis. Under certain circumstances, the spin passages constitute axial passages.

However, according to the invention it is also possible that in the stated embodiments of the new projectile the axes of the spin passages markedly change their spacing from the projectile axis between the inlet and outlet ends and are constructed to be swept by the flow from the inside to the outside or conversely. In these cases, the spin passages then constitute radial passages.

In the projectile according to the invention provision may further be made for spin passages which annularly surround the projectile axis and form an axial group of passages. Further, the projectile according to the invention may have spin passages arranged so that they surround the projectile axis in a wreath-like manner and form a radial group of passages. Finally, it is also possible in the projectile according to the invention to provide two or more spaced and successively traversed groups of passages for the production of spin in two or more stages.

The construction of the projectile with two or more spaced and successively penetrated passage groups for dual or multi-stage spin production is particularly effective.

After the propellant gas has left one group of passages and before entering the next group of passages, it is braked by friction at the surrounding walls between the groups of passages because of a system of shock waves and impacts from supersonic to subsonic speed. The pressure that is recovered in this way is again available for producing spin in the next stage.

Braking of the propellant gas between the groups of passages is associated with an increase in entropy caused by the compression shocks and by friction. This reduces the maximum possible flow of mass referred to the penetrated area, i.e. the so-called critical flow density. When the critical flow density is achieved in a passage, it always occurs in close proximity to the narrowest portion of the passage. This also applies to a group of passages or to a spin production stage in which the so-called narrowest cross-section of the stage corresponds to the narrowest total flow cross-section of all the spin passages of the stage, including all the leakage gaps.

The critical flow density which decreases in the direction of flow as described is, in such embodiments of the projectile according to the invention, taken into account by the fact that the narrowest total cross-section of a group of passages formed by the cross-sections of the individual passages of a group increases downstream from one group of passages to the next. The increase should be such that one obtains the highest possible spin effect in reference to the amount of gas used to produce spinning.

In one embodiment, the increase in the total cross-section of a group of passages is achieved in that the individual passages of a following group in each case have a larger cross-section than the individual passages of a group disposed in front of that group. In another embodiment, it is for this purpose provided that, with the same cross-section of the individual passages of all the groups, a following group comprises more passages than a group in front of that group.

To obtain the same result in a different manner, the invention further provides that, with the same narrowest total cross-section of the group of passages formed by the cross-sections of the individual passages, the groups of passages are provided with leakage gaps which become larger in the downstream direction from one group of passages to the next.

The amount of gas used to produce spinning of the projectile according to the invention can, by means of the stated construction and arrangement of the spin passages, spin passage groups and spin-producing stages, be kept very much smaller as a whole than in the known projectiles having spin passages. Consequently, the amount of gas used to produce spinning has, as a loss of propellant gas, only a small influence on the muzzle velocity of the projectile.

Although the projectile according to the invention is also provided particularly for firing from a smooth barrel, it is nevertheless suitable for shooting from a rifled barrel. For such applications of the projectile, the invention also provides for the projectile body or its guide members and its propulsion member to be underdimensioned to such an extent that its spin is not governed by the rifling of the barrel.

The invention as well as different embodiments of the projectile according to the invention are shown by way of example in the drawings wherein.

Spin passages of the kind illustrated in FIGS. 1 to 7 can be provided in or on the projectile body. However, they can also be disposed in the guide members and/or the propulsion member of the projectile if such parts are provided.

Figure 2:
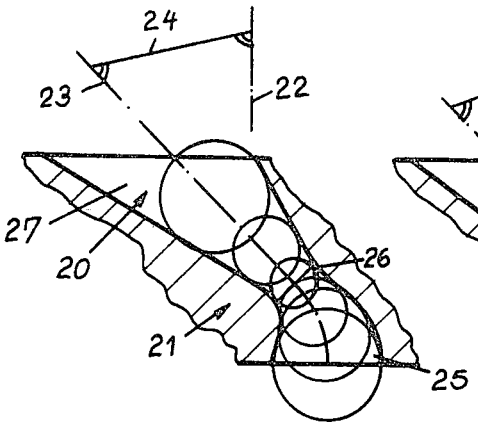
FIGS. 1 to 7 are diagrammatic cross-sections of a series of embodiments of the spin passages.
Figure 1:
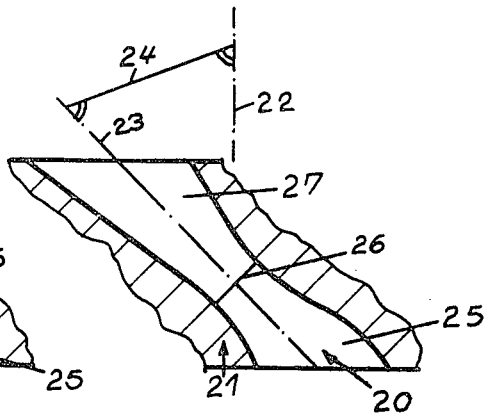

In the stated Figures, the spin passages are all designated 20 whereas the parts of the projectile in which they are disposed bear the reference numeral 21. To illustrate the possible position of the spin passages 20 in relation to the projectile axis, the latter is indicated by the chain-dotted line 22 in FIGS. 1 and 2. Further, the axis of the spin passages is in each case designated 23. In FIGS. 1 and 2, the line 24 signifies the spacing between the spin passage axis 23 and the projectile axis 22.

All the spin passages 20 illustrated in FIGS. 1 to 7 have a different cross-section over their length. Thus, the spin passages 20 have a converging cross-section on the inlet side to form a converging portion 25. This converging portion is directly adjacent a constriction 26. In the downstream direction, this constriction 26 is followed by an enlargement of the cross-section of the spin passages 20, thereby forming a diverging portion 27 thereof.

The walls of the spin passages 20 shown in FIGS. 1 and 2 are, adjacent the constriction 26, first of all convexly shaped in their diverging portion 27 and then have a straight shape.

In contrast, in the spin passages 20 of FIGS. 3 and 4 the construction is such that the walls thereof in the diverging portion 27 adjoining the constriction 26 are first slightly concavely curved and subsequently have a straight shape.

The spin passage shown in FIG. 1 has a rectilinear axis 23 which extends obliquely to the projectile axis 22 at an only slightly varying spacing therefrom. In this spin passage there is otherwise a constant change in cross-section within its converging portion 25, its constriction 26 and its diverging portion 27.

In the spin passage illustrated in FIG. 2, its axis 23 is likewise rectilinear in the region of its diverging portion 27. However, the axis 23 is curved in its converging portion 25 as well as up to its constriction 26. Nevertheless, viewed as a whole, the axis 23 of this spin passage 20 is likewise disposed at an only slightly varying spacing from the projectile axis 22 and substantially oblique thereto. Its cross-section likewise changes constantly in the region of its converging portion 25, its constriction 26 and its diverging portion 27.

Figure 3:
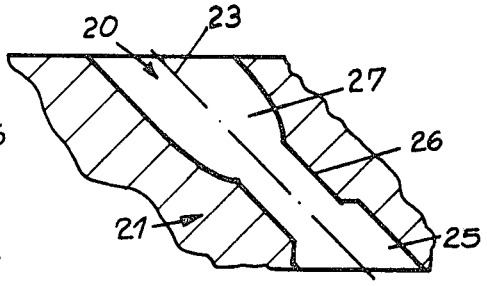

The spin passage 20 in FIG. 3 has an axis 23 corresponding in its construction and arrangement to the axis of the spin passage 20 in FIG. 1. In contrast with the spin passage of FIG. 1, however, the spin passage of FIG. 3 has an irregularly varying cross-section in the region of its converging portion 25, its constriction 26 and its diverging portion 27, particularly at the transitions between the converging portion 25 and constriction 26 and between the constriction 26 and the diverging portion 27. In the region of the constriction 26, the cross-section is constant as such.

Figure 4:
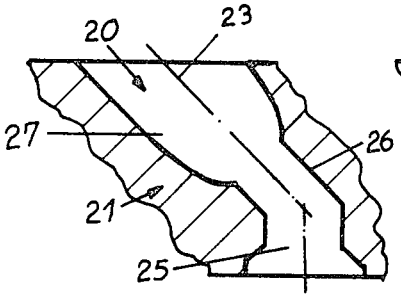

FIG. 4 illustrates a spin passage 20 with an axis 23 which is rectilinear in the region of the diverging portion 27 as well as the constriction 26 where it is arranged in a manner corresponding to the axis of the spin passage of FIG. 2. The axis 23 of the spin passage of FIG. 4 is cranked in its converging portion 25 and as a result of this cranking the axis of the spin passage is here parallel to the projectile axis. Apart from this, the cross-section of the spin passage of FIG. 4 changes irregularly over its length, particularly in the region of its converging portion 25 as well as at the transitions between the converging portion 25 and the constriction 26 and between the constriction 26 and the diverging portion 27. In contrast, in the region of the constriction 26 the spin passage likewise has a constant cross-section as such.

In the spin passages 20 shown in FIGS. 1 and 3, the production of spinning relies exclusively on the expansion of the propellant gas therein and its associated acceleration and change in spinning about the projectile axis 22. On the other hand, in the spin passages of FIGS. 2 and 4 the production of spinning is additionally caused by a change in the direction of flow of the propellant gas through deflection in the region of its converging portion 25.

The circles included in FIG. 2 show how the propellant gas flowing through the spin passage 20 is subjected to expansion to reach sonic speed in the converging portion 25 up to the constriction 26 and further accelerated to supersonic speed in the diverging portion 27. Further, it will be seen how the propellant gas is deflected in the converging portion 25 of the spin passage 20 but can flow without hindrance and without deflection through its diverging portion 27 and out of same.

Figure 5:
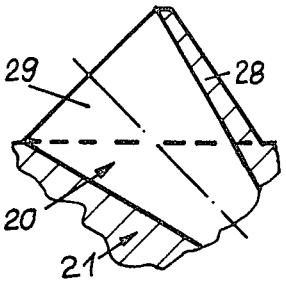
Figure 6:
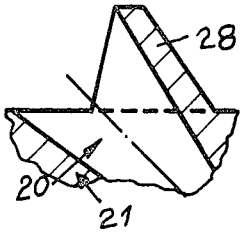
Figure 7:
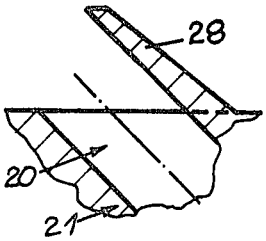

The spin passages in FIGS. 5 to 7 have the peculiarity that the part of their wall on the pressure side is provided with an extension 28 at the downstream end and thus in the region of its diverging portion 27. As shown by these figures, such extension 28 may be variously constructed. Thus, it may merge with an adapted opposed wall portion 29 to result in a trumpet-like exit end for the spin passage 20. Further, it may have a semi-dished construction as shown in FIG. 6 whereby the spin passage 20 will then have a beak-like form at its exit end. Finally, it can also be tongue-shaped as in FIG. 7.

In FIGS. 8 to 11 which show projectiles disposed in barrels, the barrel is in each case designated R and the projectile disposed therein has the general reference G.

Figure 8:
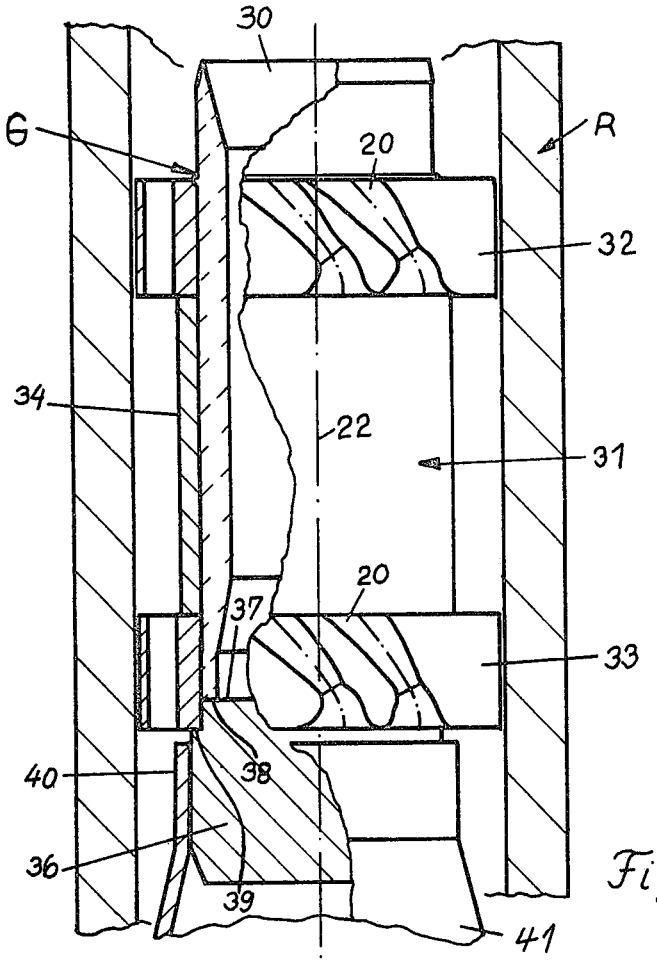
FIG. 8 is a fragmentary view of a sub-calibre barrel projectile disposed in a barrel and shown partly in plan and partly in cross-section.
Figure 9:
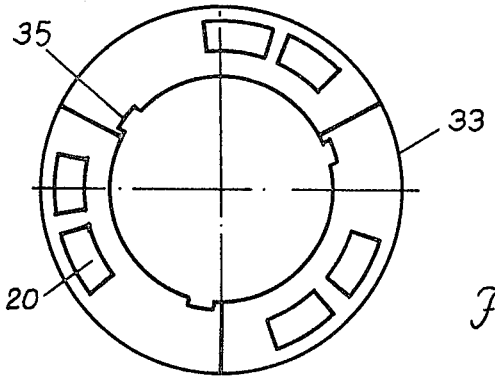
FIG. 9 is an end elevation of the guide members of the projectile shown in FIG. 8.

In the embodiment shown in FIGS. 8 and 9, the projectile G has a subcalibred tubular projectile body 30. A guide cage 31 is indicated around the projectile body 30 with a positive fit. The guide cage 31 comprises a front guide ring 32 disposed in the vicinity of the front end of the projectile body 30, a rear guide ring 33 provided at the rear end of the projectile body 30, and a hollow cylindrical spacer member 34 disposed therebetween. The external diameter of the guide rings 32, 33 corresponds to the calibre of the barrel R whereas the external diameter of the spacer member 34 is considerably less. The rings 32, 33 as well as the spacer member 34 of the guide cage 31 are composed of three longitudinal segments which are merely interconnected by frangible portions. Each segment forms one section of the guide rings 32, 33 and the spacer 34. For the positive fit arrangement of the guide cage 31 on the projectile body 30, its segments are provided with longitudinal grooves 35. The projectile body 30 has corresponding longitudinal grooves (not shown). The positive fit connection between the guide cage 31 and the projectile body 30 is brought about by means of parts which fit into the longitudinal grooves and are likewise not shown.

Spin passages 20 are provided in the guide ring 32 as well as in the guide ring 33. The spin passages 20 have a construction corresponding to that of FIG. 2. The spin passages 20 of the guide ring 33 form a first group of axial passages and the spin passages 20 of the guide ring 32 form a second group of axial passages. When the propellant gas flows through the two groups of passages, the latter therefore also result in two-stage spin production.

Adjoining the rear end of the projectile body 30 there is a propulsion member 36. This propulsion member 36 has its front wall 37 abutting the end wall 38 of the projectile body 30. At its front end the propulsion member 36 has an annular external shoulder 39. By means of this shoulder 39 it also abuts the rear end of the guide ring 33.

To connect the propulsion member 36 to the projectile body 30 and the guide cage 31 there are means (not shown) which hold same together before the projectile G is fired but, when the projectile 30 leaves the barrel, permit ready separation of the propulsion member 36 from the projectile body 30 and the guide cage 31.

The rear end of the propulsion member 36 extends into the aperture 40 of the propellant container 41 of the projectile G to an extent substantially equal to half the calibre of the projectile. The propulsion member 36 as well as the aperture 40 of the propellant container 41 have a diameter which permits the spin passages 20 of the guide ring 33 to be disposed beyond the confines of same.

When shooting the projectile G illustrated in FIGS. 8 and 9, the projectile body 30 is conveyed out of the barrel R by the propellant gas with the assistance of the propulsion member 36. As long as the propulsion member 36 is disposed in the propellant container 41, the propellant gas acts only thereon. When the propulsion member 36 has passed the aperture 40 of the propellant container 41, the propellant gas also acts on the spin passages 20, the propellant gas first flowing through the spin passages 20 of the first axial passage group disposed in the guide ring 53 and then through the spin passages 20 of the second axial passage group disposed in the guide ring 32. During flow through the spin passages 20, the projectile body 30 as well as the guide cage 31 and the propulsion member 36 have imparted to them the desired trajectory flatness within the barrel R by means of the propellant gas in the manner already described.

After leaving the barrel R, the centrifugal force acting on the guide cage 31 by reason of the trajectory flatness fractures the frangible portions interconnecting its segments and causes these segments to fly off laterally. Apart from this, the air resistance gives rise to separation of the projectile body 30 from the propulsion member 36 and the latter is left behind. Subsequently, the projectile body 30 continues its flight solely with the trajectory flatness imparted to it.

Figure 10:
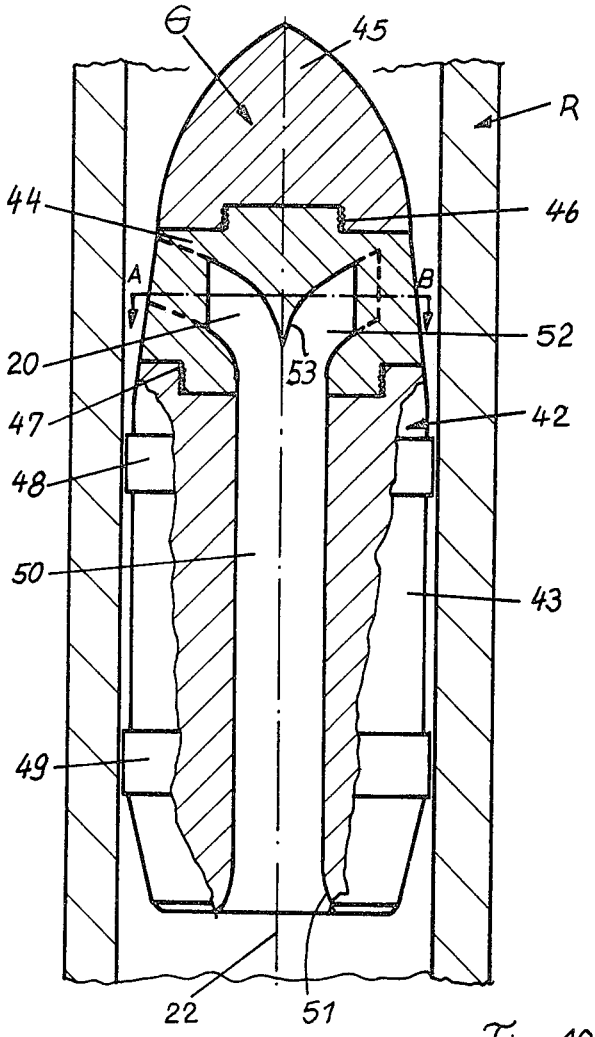
FIG. 10 shows the projectile body of a calibred solid projectile within a barrel, taken partly in plan and partly in cross-section.
Figure 11:
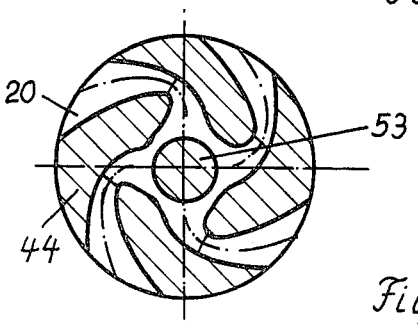
FIG. 11 is a cross-section on the line A–B of the projectile body shown in FIG. 10.

No propulsion member is provided in the case of the calibred solid projectile G shown in FIGS. 10 and 11. The body 42 of this projectile comprises a main portion 43, an intermediate portion 44 and a head 45 which are screwed together by means of screwthreads 46, 47 and of which the intermediate portion 44 as well as the head 45 have a cross-section that converges towards the tip of the projectile. Spaced guide rings 48, 49 are disposed at the main portion 43 of the projectile body 42 and made in one piece therewith.

A central bore 50 for the passage of propellant gas extends from the rear to the front end of the main portion 43 of the projectile body 42. At the inlet end this bore 50 is provided with an enlargement 51.

The intermediate portion 44 of the projectile body 42 is provided with a recess 52 at a position adjoining the bore 50 of the main portion 43 and has a diameter corresponding to that of the bore 50. This recess 52 diverges towards the front end of the projectile body 42 and merges with a group of radial spin passages 20 which annularly surround the projectile axis 32 and have a construction substantially corresponding to that of FIG. 2. In the intermediate portion 44 there is also a substantially conical projection 53 which is centrally disposed and has its tip pointing to the end of the projectile. This projection 53 helps to form the spin passages.

When the projectile G illustrated in FIGS. 10 and 11 is fired, it is propelled out of the barrel R under the direct influence of the propellant gas on its projectile body 45. When the propellant gas acts on the projectile body 45, it also enters the bore 50 and from there flows through the recess 52 as well as the spin passages 20 into the space between the inner surface of the barrel and the outer surface of the intermediate portion 44 of the projectile body 45, after which it then finally reaches the muzzle of the barrel R. During flow through the spin passages 20, the desired trajectory flatness is imparted to the projectile body 45 within the barrel R by the propellant gas in the manner already described. After leaving the barrel R, the projectile body 45 then follows its prescribed flight path with the trajectory flatness imparted to it.

I claim:

1. A projectile for shooting from a gun barrel in response to the force of a propellant gas emanating from the aperture of a propellant container, comprising a projectile body having a plurality of spin-producing propellant gas flow passages associated therewith, said passages annularly surrounding, and having their respective axes extending obliquely to, the longitudinal axis of the projectile body, wherein each passage has an inlet portion converging to an adjoining constricted portion, and a diverging portion extending downstream from the constricted portion, the axis of each passage being curved over the entire length of its converging inlet portion and substantially rectilinear over its diverging portion, and the walls of the diverging portion of each passage having a substantially rectilinear form, as viewed in the direction of propellant gas flow.

2. A projectile as claimed in claim 1, wherein at the outlet end of each flow passage, the pressure side of its bounding wall bears an extension.

3. A projectile as claimed in claims 1 or 2, wherein the distance between the axis of each flow passage and the longitudinal axis of the projectile body is substantially constant over the length of the flow passage, and wherein the flow passages are situated axially.

4. A projectile as claimed in claims 1 or 2, wherein the axis of each flow passage has a widely varying spacing from the longitudinal axis of the projectile body, and wherein the flow passages are situated radially.

5. A projectile as claimed in claim 4, wherein the flow passages are arranged in two or more groups which are spaced apart so as to be successively penetrated by the propellant gas for multi-stage spin production, and wherein the groups are arranged so that the total cross-sectional area of the passages in each group, measured at their narrowest dimension, increases downstream from one group to the next.

6. A projectile as claimed in claim 5, wherein the individual passages of a group have a cross-sectional area, measured at their narrowest dimension, larger than that of the individual passages of the group situated immediately upstream.

7. A projectile as claimed in claim 5, wherein all of the passages have substantially the same cross-sectional area, measured at their narrowest dimension, and wherein the number of passages in each group increases downstream from one group to the next.

8. A projectile as claimed in claim 3, wherein the flow passages are arranged in two or more groups which are spaced apart so as to be successively penetrated by the propellant gas for multi-stage spin production, and wherein the groups are arranged so that the total cross-sectional area of the passages in each group, measured at their narrowest dimension, increases downstream from one group to the next.

9. A projectile as claimed in claim 8, wherein the individual passages of a group have a cross-sectional area, measured at their narrowest dimension, larger than that of the individual passages of the group situated immediately upstream.

10. A projectile as claimed in claim 8, wherein all of the passages have substantially the same cross-sectional area, measured at their narrowest dimension, and wherein the number of passages in each group increases downstream from one group to the next.

11. A projectile as claimed in claim 3, wherein the flow passages are arranged in two or more groups which are spaced apart so as to be successively penetrated by the propellant gas for multi-stage spin production, wherein the total cross-sectional area of the passages in each group, measured at their narrowest dimension, is substantially the same, and wherein each of the groups is provided with propellant gas leakage gaps, with the gaps increasing downstream from one group to the next.

12. A projectile as claimed in claim 4, wherein the flow passages are arranged in two or more groups which are spaced apart so as to be successively penetrated by the propellant gas for multi-stage spin production, wherein the total cross-sectional area of the passages in each group, measured at their narrowest dimension, is substantially the same, and wherein each of the groups is provided with propellant gas leakage gaps, with the gaps increasing downstream from one group to the next.

* * * * *